United States Patent [19]

Harayama

[11] 4,062,741

[45] Dec. 13, 1977

[54] METHOD FOR MAINTAINING AN ELECTRODE AND AN ARTICLE PLATED OR TO BE PLATED IMMERSED IN AN ELECTROLYTIC CHROMIUM-PLATING BATH IN A NORMAL CONDITION

[75] Inventor: Akira Harayama, Okaya, Japan

[73] Assignee: Teikoku Piston Ring Co., Ltd., Japan

[21] Appl. No.: 659,799

[22] Filed: Feb. 20, 1976

[51] Int. Cl.$^2$ ..... C25D 3/04; C25D 5/00

[52] U.S. Cl. ..... 204/51; 204/DIG. 9

[58] Field of Search ..... 204/DIG. 9, 51

[56] References Cited

U.S. PATENT DOCUMENTS 3,042,592 7/1962 Schaer ..... 204/51

*Primary Examiner*—F.C. Edmundson

*Attorney, Agent, or Firm*—Paul & Paul

[57] ABSTRACT

An electrode and an article plated, or to be plated, immersed in an electrolytic chromium-plating bath can be maintained in a normal condition even while electricity for plating is not supplied, by applying a low DC voltage of 1.27 to 2.2 volts between the electrode and the article while keeping them in the plating bath.

5 Claims, 1 Drawing Figure

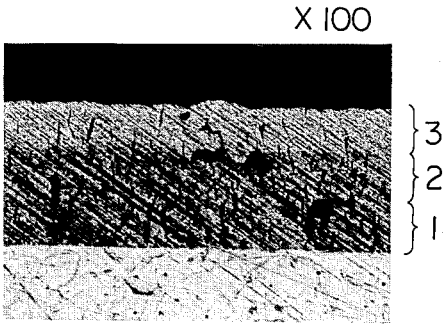
X 100
3
2
1

METHOD FOR MAINTAINING AN ELECTRODE AND AN ARTICLE PLATED OR TO BE PLATED IMMERSED IN AN ELECTROLYTIC CHROMIUM-PLATING BATH IN A NORMAL CONDITION

The present invention relates to a method for maintaining an electrode and an article plated, or to be plated, immersed in an electrolytic chromium-plating bath in a normal condition. More particularly, the present invention relates to a method for protecting an electrode and an article plated, or to be plated, immersed in an electrolytic chromium-plating bath, for undesirable deterioration thereof while electricity for plating is not supplied to the plating system.

When the supply of electricity to a plating system having an electrode and article plated, or to be plated, immersed in an electrolytic plating bath, is interrupted, the interruption results in the following undesirable deterioration of the electrodes, article and plating bath.

1. When a plated article is kept in the plating bath while the supply of electricity for plating is interrupted during the plating process, a surface portion of the plated chromium layer on the article is oxidized. Such oxidized portion of the plated chromium layer has a low activity for bonding with an additional chromium layer to be further plated thereon. Accordingly, in the case where an additional plating operation is effected on the plated article, it is required that the oxidized surface portion of the plated chromium layer be etched by applying a DC voltage for etching in an opposite direction to that of the above-mentioned plating voltage application before the start of the additional plating operation.

2. The above-mentioned etching results in non-uniformity in thickness and activity of the plated chromium layer. Accordingly, it is very difficult to control the additional plating operation so that the sum of the first plated chromium layer and the additional plated chromium layer is uniform in thickness. As a result, the additional plated chromium layer normally has a rough surface.

3. During the time an electrode (anode) consisting of lead or a lead alloy is kept in the chromium plating bath without electricity for plating being supplied, the lead in the surface portion of the electrode is converted into lead chromate. This conversion results in a decrease in the conductivity of the electrode with the lapse of time while the electrode is immersed in the plating bath. Accordingly, when the supply of electricity for plating is interrupted, in order to prevent the deterioration of the electrode, it is necessary to remove the electrode from the plating bath immediately.

4. If a non-plated article is kept in the chromium-plating bath during the time the supply of electricity for plating is interrupted, an outer surface portion of the article is dissolved into the plating bath due to a so-called cell effect. This dissolution results in the undesirable deformation of the article and in the undesirable deterioration of the plating bath. Accordingly, when the supply of electricity for plating is interrupted, it is required to remove the article from the plating bath as soon as possible.

As is stated above, if the supply of electricity for plating is interrupted during the plating process, the interruption results in the undesirable additional operations of removing from the plating bath and then returning to the plating bath the electrode and the article and of etching the oxidized surface portion of the plated chromium layer. The interruption also results in an increase in the percent of defective plated products.

It is known that an automatic plating system for simultaneously plating a plurality of articles in valuable for mass-producing a number of plated products having uniform quality with a small number of workers. However, it is also known that the automatic system tends to cause more complicated problems in the operation thereof than those in a hand plating system and, also, that the automatic system has a relatively high frequency of interruption in the operation thereof.

If the supply of electricity for the automatic plating system is interrupted during the plating process, the interruption causes the following various disadvantages which are due to the inherent properties of the automatic system itself.

A. When the automatic plating process is interrupted due to an operational problem, for example, interruption of the supplied electricity for plating, a very large number of additional operation, such as removing, washing and reinserting the numerous electrodes and articles are required.

B. The additional removing and reinserting operations for the electrodes and articles requires a long time and during this time the plating process can not be effected. Accordingly, the above-mentioned additional operations result in economical disadvantages.

C. In the additional plating operation, it is very difficult to adjust the additional plating time and conditions for each of the numerous plated articles, because it is difficult to know, before the start of the additional plating operation, the conditions of all of the numerous plated chromium layers on the articles and of the plating bath. This difficulty in adjusting the additional plating time results in an increase of the percentage defective products. Sometimes, it becomes necessary to remove the plated chromium layers from the articles and subject the articles to a plating process again.

D. In order to reduce the percentage of defective plated products and to prevent the above-mentioned removal and additional plating process, it is necessary that the automatic plating system be provided with an additional system for adjusting the additional plating time for the articles and for controlling the electric power source so as to elevate, in steps, the voltage for plating the article.

E. In order to resume the plating operation after the interruption of the supplied electricity for plating it is necessary that the automatic plating system be provided with an additional system for effecting the etching operation of the article.

F. The automatic plating system must be provided with a hand operated system for removing and re-inserting the article and the electrodes.

G. Generally, the automatic system is provided with equipment for clarifying the plating bath waste. When the supplied electricity for plating is interrupted, it is necessary to remove the article and electrode from the plating bath and wash them to prevent the deterioration thereof. The washing operation naturally produces a certain amount of plating liquid waste. This plating liquid waste must be clarified even if the clarifying equipment for the plating bath waste does not work due to the interruption of the supplied electricity for plating. Accordingly, the automatic plating system must be provided with additional equipment for clarifying the plating liquid waste during the time the supplied electricity for plating is interrupted.

H. In order to operate the above-mentioned additional equipment and carry out the plating liquid waste clarifying operations when the supplied electricity for plating is interrupted, it is necessary to have a separate generator of electricity. Further, since all of the above-mentioned addtitional equipment and operations must be operated and carried out, respectively, when the supplied electricity for plating is interrupted, it is required that the separate generator have a large capacity. Such a requirement is, of course, economically disadvantageous.

In view of the above-mentioned circumstances, it is desired to provide a method which is capable of eliminating or reducing the above-mentioned technical and economical disadvantages resulting from the interruption of the supplied electricity to the plating system.

An object of the present invention is to provide a method for maintaining an electrode and an article plated, or to be plated, immersed in an electrolytic chromium-plating bath, in a normal condition, while electricity for plating is not supplied, without removing the electrode and the article from the plating bath.

Another object of the present invention to provide a method for maintaining an electrode and an article plated, or to be plated, immersed in an electrolytic chromium-plating bath, in a normal condition, while electricity for plating is not supplied, by an easy and simple operation.

A further object of the present invention is to provide a method for maintaining an electrode and an article plated, or to be plated, immersed in an electrolytic chromium-plating bath, in a normal condition, while electricity for plating is not supplied by the normally used source thereof, by using a separate low DC voltage source which is capable of being easily used as a source of electricity.

The above-mentioned objects can be attained by the present invention for maintaining an electrode and article plated, or to be plated, immersed in an electrolytic chromium-plating bath, in a normal condition, while electricity for plating is not supplied, which comprises applying a low DC voltage of 1.27 to 2.2 volts between an electrode and an article plated, or to be plated, while the electrode and article are kept immersed in the plating bath.

In the method of the present invention, in order to prevent the deterioration of the electrode and the article immersed in the chromium-plating bath, a low DC voltage of 1.27 to 2.2 volts, preferably, 1.7 to 2.0 volts is applied between the electrode and the article without removing them from the plating bath. The DC voltage is present in a voltage range lower than the voltage for plating at which chromium is deposited on the article. Due to the application of the low DC voltage, oxygen and hydrogen in a nascent state are generated on the surfaces of the electrode and the article, respectively. The surfaces of the electrode and the article are vigorously washed with the oxygen and hydrogen in a nascent state and thereby protected from deterioration.

If a DC voltage lower than 1.27 volts is applied, the oxygen and hydrogen in a nascent state are generated in amounts insufficient for protecting the electrode surface and the article surface, respectively. The application of a DC voltage higher than 2.2 volts, but lower than the operative voltage, results in the undesirable deposit of chromium on the article surface. The above-mentioned higher voltage results in such undesired characteristics as lustre, hardness, and non-uniform thickness, and location on the chromium layer on the article. Accordingly, the undesirable deposit of chromium results in a reduction in the quality of the plated product. The undesirable deposit also results in difficulty in adjusting the additional plating time to obtain a desired thickness of plated chromium layer. Further, the application of a DC voltage higher than 2.2 volts cause not only the above-mentioned disadvantages but an economical disadvantage.

In the method of the present invention, the application of the low DC voltage may be effected after the article and the electrode are inserted into the plating bath but before the application of the plating voltage is started. The application of the low DC voltage may also be effected while the application of the plating voltage is interrupted during the plating process. Finally, the application of the low DC voltage may be effected after the application of the plating voltage is finished but before the article and the electrode are removed discharged from the plating bath.

The method of the present invention can result in the following benefits in the chromium plating process.

1. Even if the supply of electricity for plating is interrupted, the additional operations of removing, washing and re-inserting the electrode and the article are not necessary.

2. Even if an additional plating operation is required after the interruption of the electricity for plating, no etching operation for the article is necessary, because the article is not oxidized during the interruption period of the electricity for plating.

3. It is easy to known how long the additional plating operation must be continued to obtained a desired thickness of the plated chromium layer. This results in a decrease in the percent of defective plated products.

4. It becomes possible to optionally adjust the residence period of the article in the plating bath before the plating process is started or after the plating process is finished. This makes it possible to operate the automatic plating system for a plurality of articles with a small number of workers. That is, the efficiency of the plating process can be improved.

5. Since additional equipment, for example, equipment for the etching operation and for the clarification of the plating liquid waste, is not necessary, the cost of the plating equipment is lower than for a method requiring such additional equipment. For example, the cost of the electricity supply equipment utilized with the method of the present invention is about 60% of that of conventional equipment having the same capacity.

6. The amount of the plating liquid waste is smaller, because the additional operations required for removing and washing the electrode and the article are unnecessary when the method of the present invention is utilized.

7. The bonding activity of the plated chromium layer surface can be maintained at a high level, because the surface can be protected from oxidation even when electricity for plating is not supplied.

8. The deterioration of the plating bath and the electrode (anode) can be prevented. This prevention results in the improvement of the quality of the plated products and in the reduction of the cost of the plating process.

9. The plating system utilizing the method of the present invention can be easily retained in a normal condition.

In order to effect the method of the present invention, the following additional equipment is necessary.

1. Rectifiers for automatically applying a predetermined low DC voltage to the electrodes and the articles, the number of the rectifiers being the same as a maximum number within which the articles can be plated in a plating system.

2. An automatic change-over switch for changing from the normally used source of electricity for plating to a separate source of electricity for the low DC voltage when the electricity for plating is interrupted.

3. A separate electricity source, for example, a generator or condenser, for the low DC voltage, said source being capable of supplying a predetermined DC voltage within a very short time, for example, shorter than 10 seconds, after the supply of electricity for plating is interrupted.

The total cost of the above-mentioned additional equipment is lower than that of the required additional equipment for the conventional plating system.

Additionally, since the method of the present invention can be applied to any type of chromium plating bath, the utilization of the method of the present invention has a very high industrial value.

The following specific example will serve to illustrate the practice of the present invention, but are in no way to be construed as limiting thereon.

EXAMPLE 1

A cylinder sleeve for an internal combustion engine, having an outside diameter of 90 mm, an inside diameter of 80 mm and a length of 200 mm, and made of cast iron, was pretreated for plating using the following procedures. First, the cylinder sleeve was degreased by treating it with an alkali solution in accordance with common practice. The inside peripheral surface of the degreased cylinder sleeve was subjected to a liquid honing with an aqueous suspension of 1 part by weight of abrasive alumina grains having a 200 to 500 mesh size (Tyler Standard) in 3 parts by weight of water under a pressure of 5 kg/cm$^2$. Thereafter, the inside surface of the honed cylinder sleeve was etched by immersing it in an etching bath containing 250 g/l of chromium trioxide for 10 seconds, to which bath 30 A/dm$^2$ of DC electricity was applied. The outer peripheral surface of the cylinder sleeve was masked with a conventional masking material.

The above-pretreated cylinder sleeve was plated with chromium by means of the following process. A plating bath was used which consisted of a self regulating chromium plating solution containing 250 g/l of chromic anhydride 1 g/l of sulfaric acid, 10 g/l of potassium silicofluoride and 30 g/l of potassium dichromate. An anode for the plating bath, made of an alloy consisting of 8% by weight of tin and 92% by weight of lead, was electrically connected to an electric power source. The pretreated cylinder sleeve was used as a cathode and electrically connected to the electric power source.

In a first plating operation, the anode and the cylinder sleeve were immersed in the plating bath and a DC plating voltage of 6 volts was applied between the anode and the cylinder sleeve for four hours so as to allow a current of 45 A/dm$^2$ to flow therebetween. After the first plating operation was finished, the cylinder sleeve was kept in the plating bath for 50 seconds without application of the plating voltage and, thereafter, a low DC voltage of 1.9 volts was applied between the anode and the cylinder sleeve for three hours.

In a second plating operation, a plating voltage of 6 volts was applied between the anode and the cylinder sleeve for three hours instead of the above low voltage, so as to allow a current of 45 A/dm$^2$ to flow therebetween. When the second plating operation was finished, the plated cylinder sleeve was removed from the plating bath immediately.

A cross-sectional surface of the plated cylinder sleeve was prepared in accordance with common practice and observed by way of a metallurgical microscope. As viewed through the microscope, a first chromium layer which was formed by the first plating operation could not be distinguished from a second chromium layer which was formed by the second plating operation, because the second layer was combined with the first layer without a boundary intersurface betweem them. That is, the first layer and second layer were unified into one body.

The plated cylinder sleeve was subjected to a chisel test in accordance with the disclosure in Plating, pages 913 and 914, July, 1956, and to a push out test in accordance with JIS H-8615 (1972). The results of both tests showed that the second chromium layer was firmly bonded to the first chromium layer to an extent that the second layer could not be separated from the first layer.

For the purpose of comparison, the above-mentioned operations were repeated and, thereafter, the plated cylinder sleeve was subjected to the following third plating operation. When the second plating operation was finished, the plated cylinder sleeve was immediately removed from the plating bath and kept outside the plating bath for 90 seconds while the same operational voltage as in the second plating operation was applied between the anode and the cylinder sleeve and while the cylinder sleeve was allowed to dry in the air. Thereafter, the cylinder sleeve was re-inserted into the plating bath and subjected to a third plating operation. The third plating operation was carried out using the same procedures as in the second plating operation. When the third plating operation was finished, the plated cylinder sleeve was removed from the plating bath immediately.

The plated cylinder sleeve was subjected to a microscopic observation of the cross-sectional surface thereof in the same manner as stated above. The result is shown in the accompanying photograph, in which the first chromium layer 1 can not be distinguished from the second chromium layer 2, whereas the third chromium layer 3 formed by the third plating operation can definitely be distinguished from the second chromium layer 2.

EXAMPLE 2

One hundred and fifth piston rings, each having a thickness of 2 mm, an outside diameter of 90 mm and an inside diameter of 82 mm were superposed so as to form a cylindrical body. The cylinder thus formed was degreased, liquid honed and etched in the same manners as in Example 1 with the exception that the outside peripheral surface of the cylinder was liquid honed and etched while the inside periphery of the cylidner was masked. The pretreated cylinder was plated by the following process. The plating bath used was a so-called Sargent bath containing 250 g/l of chromic anhydride and 2.5 g/l of sulfuric acid. The anode used was made of an alloy consisting of 93% by weight of lead and 7% by weight of antimony. The anode and the pretreated cylinder (cathode) was inserted into the plating bath and kept therein for 20 minutes while a low DC voltage of 1.9 volts was applied between the anode and the cylinder sleeve so as to allow a current of 2A/dm² to flow therebetween. Then, the cylinder was subjected to a first plating operation wherein a plating voltage of 6 volts was applied for two hours so as to allow a current of 45 A/dm² to flow therebetween.

When the first plating operation was finished, the application of the plating voltage was stopped for 10 seconds while keeping the anode and the plated cylinder in the plating bath. Thereafter, a low DC voltage of 1.9 volts was applied between the anode and the cylinder in the plating bath for three hours. The cylinder was subjected to a second plating operation which was carried out for three hours in the same manner as in the first plating operation. Next, a low DC voltage of 1.9 volts was applied between the anode and the cylinder cathode in the plating bath for 30 minutes. Finally, the plated cylinder was removed from the plating bath.

The plated piston ring was subjected to the same microscopic observation of the cross-sectional surface thereof as in Example 1. It was observed that there was no boundary intersurface between the first chromium layer formed by the first plating operation and the second chromium layer formed by the second plating operation. It was also observed that the plated chromium layer was firmly bonded to the piston ring surface in spite of keeping the piston ring to be plated in the plating bath for 20 minutes without application of the plating voltage before the start of the first plating operation. Further, it was observed that the outer surface of the plated chromium layer was not oxidized in spite of keeping the plated piston ring in the plating bath for 30 minutes without application of the plating voltage after the end of the second plating operation. Still further, it was observed that in spite of keeping the anode in the plating bath for 20 minutes before the start of the first plating operation, for three hours between the first and second plating operations and for 30 minutes after the end of the second plating operation, the anode had no lead chromate surface layer formed thereon.

From the above examples, it is evident that the application of the low DC voltage is effective for maintaining the anode and article cathode surfaces in the normal condition while they are immersed in the plating bath for a long period of time without the application of the plating voltage.

What is claimed is:

1. A method for protecting an anode and a cathode from deterioration during the period (1) prior to supplying electricity for plating, or (2) during an interruption in the supply of electricity during plating, said anode and said cathode remaining immersed during said period in an electrolytic, chromium-plating bath, which both tends to deteriorate said anode and said cathode during said period, said cathode consisting of a partially plated article or an article to be plated, said method comprising the step of:

normalizing said anode and said cathode in said bath during said period by maintaining a current between said anode and said cathode by impressing a low D.C. voltage of from about 1.27 to 2.2 volts, therebetween, whereby said anode and said cathode are protected from deterioration during said period.

2. A method as claimed in claim 1, wherein said application of said low DC voltage is effected after said article and anode are inserted into the plating bath but before the supply of the electricity for plating is started.

3. A method as claimed in claim 1, wherein said application of said low DC voltage is effected while the supply of the electricity for the plating is interrupted during the plating operation.

4. A method as claimed in claim 1, wherein said application of said low DC voltage is effected after the plating operation is finished but before said article and electrode are removed from the plating bath.

5. A method as claimed in claim 1, wherein said low DC voltage is present in a range of 1.7 to 2.0 volts.

* * * * *

UNITED STATES PATENT OFFICE

CERTIFICATE OF CORRECTION

Patent No. 4,062,741 Dated December 13, 1977

Inventor(s) Akira Harayama

It is certified that error appears in the above-identified patent and that said Letters Patent are hereby corrected as shown below:

On the Title Page of the above United States Patent, after line [22], which reads: "Filed: Feb. 20, 1976", insert a new line:

[33] -- Foreign Application Priority Data

Feb. 24, 1975 Japan .....21871/75 --.

Column 2, line 6, after the word "articles" delete "in" and insert therefore -- is --

Column 4, line 34, after the word "to" delete "known" and insert therefore -- know --

Column 4, line 35, after the word "to" delete "obtained" and insert therefore -- obtain --

Column 6, line 54, after the word "and" delete "fifth" and insert therefore -- fifty --

Signed and Sealed this

*Fourth* Day of *July 1978*

[SEAL]

*Attest:*

RUTH C. MASON
*Attesting Officer*

DONALD W. BANNER
*Commissioner of Patents and Trademarks*